US007570216B2

(12) United States Patent
Itsuji

(10) Patent No.: US 7,570,216 B2
(45) Date of Patent: Aug. 4, 2009

(54) ANTENNA DEVICE

(75) Inventor: Takeaki Itsuji, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/023,863

(22) Filed: Jan. 31, 2008

(65) Prior Publication Data

US 2008/0186239 A1 Aug. 7, 2008

(30) Foreign Application Priority Data

Feb. 1, 2007 (JP) ..... 2007-023596

(51) Int. Cl.
*H01Q 1/38* (2006.01)

(52) U.S. Cl. ..... 343/700 MS; 343/828

(58) Field of Classification Search ..... 343/700 MS, 343/825, 828, 829, 846
See application file for complete search history.

(56) References Cited

U.S. PATENT DOCUMENTS 6,448,553 B1 9/2002 Itsuji et al.
6,835,925 B2 12/2004 Itsuji et al.
7,245,259 B2 * 7/2007 Puckey et al. ..... 343/700 MS
7,248,995 B2 7/2007 Itsuji et al.
7,286,095 B2 * 10/2007 Parsche et al. ..... 343/773
7,317,420 B2 * 1/2008 Aisenbrey ..... 343/700 MS
7,358,901 B2 * 4/2008 Eberhardt et al. ..... 343/700 MS
7,358,918 B2 4/2008 Itsuji
2007/0030115 A1 2/2007 Itsuji et al.
2007/0235718 A1 10/2007 Kasai et al.

OTHER PUBLICATIONS

Masahiko Tani, et al., Emission Characteristics Of Photoconductive Antennas Based On Low-Temperature-Grown GaAs And Semi-Insulating GaAs, Applied Optics, Oct. 20, 1997, vol. 36, No. 30, pp. 7853-7859.

Jenshan Lin, et al., Two-Dimensional Quasi-Optical Power-Combining Arrays using Strongly Coupled Oscillators, IEEE Transactions on Microwave Theory and Techniques, Apr. 1994, vol. 42, No. 4, pp. 734-741.

U.S. Appl. No. 10/587,262, filed Jul. 26, 2006, Itsuji.

* cited by examiner

*Primary Examiner*—HoangAnh T Le
(74) *Attorney, Agent, or Firm*—Fitzpatrick, Cella, Harper & Scinto

(57) ABSTRACT

An antenna device for operating in a predetermined frequency band has a resonator section, a semiconductor section and an antenna section. The resonator section includes a first conductor section, a dielectric section, and a second conductor section for specifying a reference potential against each section which is arranged so as to oppose the first conductor section through the dielectric section. A semiconductor section is arranged so as to be sandwiched between the first conductor section and the second conductor section. The antenna section uses the second conductor section as a grounding conductor, is substantially spherical, makes at least its surface electroconductive, and is arranged on the first conductor section.

12 Claims, 5 Drawing Sheets

ANTENNA DEVICE

BACKGROUND OF THE INVENTION

1. Field of the Invention

The present invention relates to an antenna device which integrates an antenna section with a medium for generating or detecting electromagnetic waves.

More specifically, the present invention relates to an antenna device which generates or detects a high-frequency electromagnetic wave (referred to as a terahertz wave in this specification) having an arbitrary band in the range between 30 GHz and 30 THz.

2. Description of the Related Art

In recent years, nondestructive inspection technologies have been developed which use terahertz waves. It is known that absorption lines of various materials including biomolecules are present in the frequency region of terahertz waves. An imaging technique for performing safe radiological examination without using X-rays is known in the field of application of electromagnetic waves of this frequency region. A spectroscopic technique for examining a bonding state of molecules by measuring an absorption spectrum or a complex permittivity in the inner part of a material is also known. In addition, techniques for analyzing biomolecules and techniques for evaluating the density or mobility of carriers are expected.

For developing these techniques, a technique of generating and detecting a terahertz wave is important. As such a technique, it is reported that a device for generating and detecting a terahertz wave was produced by patterning a flat-type antenna pattern and a fine gap on a semiconductor substrate (see Appl. Opt., Vol. 36, No. 30, pp. 7853-7859 (1997)). The device provides a terahertz wave by exciting a carrier in a gap by using an ultrashort pulsed-laser (femtosecond laser, for example) and accelerating the carrier by using an electric field separately applied to the gap. The structure of the device is adapted for operating as a detecting device as well.

Further, there is a technique for generating a terahertz wave by using a semiconductor technology. For instance, techniques using a gain medium such as a Gunn diode and a resonant tunneling diode (RTD) are known. Generators employing these gain mediums will constitute an oscillating circuit containing these gain mediums and properly regulate a load resistance and a phase in a desired frequency region to realize an oscillation state.

Conventionally, an electromagnetic wave obtained in this way is often radiated to the outside through a radiation device such as an antenna to which the generator has been connected. However, in the case of an electromagnetic wave in a high-frequency region, it is difficult to efficiently radiate the electromagnetic wave to the outside due to a propagation loss of the electromagnetic wave and a mismatch occurring between individually designed devices. For this reason, it is tried to regard an antenna device as one part of the load resistance constituting an oscillating circuit and integrate the antenna device into a monolithic structure (see IEEE Transaction on Microwave Theory Tech., vol. 42, pp. 734-741, 1994).

The antenna oscillator proposed in IEEE Transaction on Microwave Theory Tech., vol. 42, pp. 734-741, 1994 is of a transmission line or micro-strip line (MSL) type. The antenna oscillator has a patch antenna connected to a Gunn diode which is formed in the thickness direction of a dielectric film constituting a transmission line. The antenna oscillator uses the patch antenna as one part of the load resistance so as to satisfy the oscillation-starting condition expressed by the expressions (1) and (2) given below. The antenna oscillator also employs a stub for adjusting the phase in order to satisfy the phase condition. In addition, the patch antenna and another transmission line constituting a circuit are connected by an impedance converter circuit. As a whole, the present antenna oscillator has a configuration in which the components are integrated into a planar state.

(1) Real part of admittance: $\mathrm{Re}\,[Y_{act}+Y_{load}]<0$ (2) Imaginary part of admittance: $\mathrm{Im}[Y_{act}+Y_{load}]=0$ In the above respective expressions (1) and (2) specifying the conditions for gain and phase, $Y_{act}$ and $Y_{load}$ correspond to the admittance of a gain device (Gunn diode) and the admittance of a transmission line type oscillating circuit including the antenna, respectively.

SUMMARY OF THE INVENTION

The band of a terahertz wave which is generated by a photoconductive device as shown in Appl. Opt., Vol. 36, No. 30, pp. 7853-7859 (1997) is specified by the mobility of a carrier in a semiconductor. Generally, such a semiconductor substrate has a high permittivity. Then, a part of the terahertz wave is subjected to total reflection by the difference of refractive index at the boundary of the semiconductor substrate and the atmosphere and is confined in the semiconductor substrate. Accordingly, the takeout efficiency for the terahertz wave is degraded. In order to alleviate such a reflection condition at the interface and take out the terahertz wave to the outside, there is proposed a technique, for instance, of attaching a hemispherical lens made of substantially the same material as the semiconductor substrate to the substrate side. However, in this case, the takeout efficiency is deteriorated due to the influence of reflection caused by the air layer formed between the hemispherical lens and the substrate and also due to the propagation loss in the hemispherical lens.

Furthermore, in the technique shown in IEEE Transaction on Microwave Theory Tech., vol. 42, pp. 734-741, 1994, an oscillating circuit including an antenna is connected with a gain medium in parallel and functions as an oscillator. Generally, in a high frequency circuit, the shorter the wavelength, the smaller the circuit scale. As a result, it is difficult to give a sufficient load resistance to the antenna device to be used as one part of the load resistance. More specifically, the resistance of the antenna device is lowered as the wavelength is made shorter. The antenna device is connected to the gain medium in parallel so that the value of $Y_{load}$ increases as the resistance of the antenna device decreases. As a result, in the terahertz wave region, it is difficult for the oscillator to satisfy the above described condition (1) in terms of the real part of admittance, hence being likely to function unstably. In addition, the oscillator has the problem of hardly causing oscillation though it depends on the wavelength.

In view of the above described problems, an antenna device according to the present invention, which operates in a predetermined frequency band, has a resonator section, a semiconductor section and an antenna section. The resonator section includes a first conductor section, a dielectric section, and a second conductor section for defining a reference potential for each section which is arranged so as to oppose the first conductor section through the dielectric section in the antenna device. The semiconductor section is sandwiched between the first conductor section and the second conductor section. The antenna section is generally solid and at least its surface is conductive, which is arranged on the first conductor section and works with the second conductor section as a grounding conductor. The above described predetermined frequency band is in a range, for instance, of 30 GHz to 30 THz.

The antenna device of the present invention has a configuration in which the antenna section is supported by an external part on the first conductor section of the resonator section. Thus, the antenna device of the present invention can reduce the loss due to a dielectric section as compared to one having a planar antenna structure. Accordingly, the antenna device of the present invention shows an improved takeout efficiency (or uptake efficiency if used as a detection device) for an electromagnetic wave.

Further features of the present invention will become apparent from the following description of exemplary embodiments with reference to the attached drawings.

DESCRIPTION OF THE EMBODIMENTS

Figure 1:
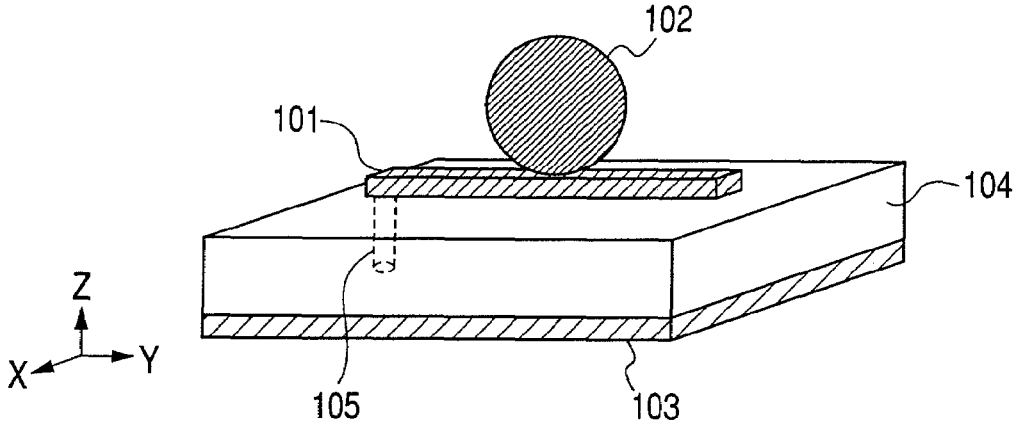
FIG. 1 is a perspective view showing an exemplary configuration of the antenna device according to the present invention.

Typical embodiments according the present invention will now be described below with reference to the drawings. In the drawings, the same symbols will be used for elements having the same function.

FIG. 1 illustrates an exemplary configuration of the antenna device according to the present invention. As illustrated in FIG. 1, the antenna device of this embodiment includes a first conductor section 101, an antenna section 102, a second conductor section 103, a dielectric section 104 and a semiconductor section 105. As illustrated in FIG. 1, the plane direction of the second conductor section 103 is defined as XY direction, and the direction normal to the XY direction is defined as Z direction.

Figure 2A:
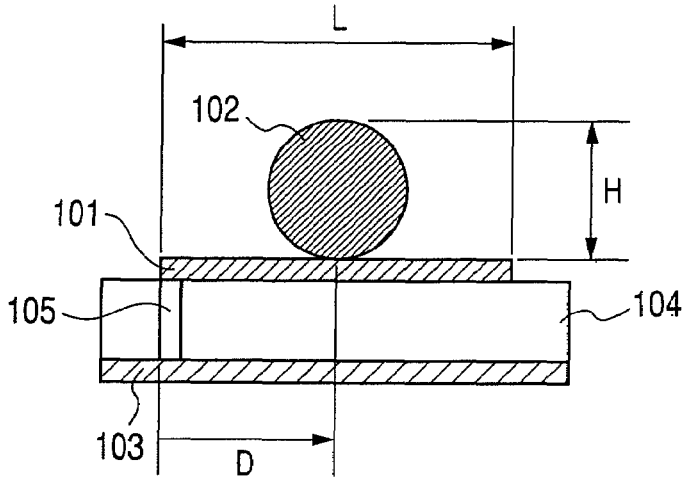
FIGS. 2A and 2B are sectional views showing the antenna device of FIG. 1 according to the present invention, with some parameters.
Figure 2B:
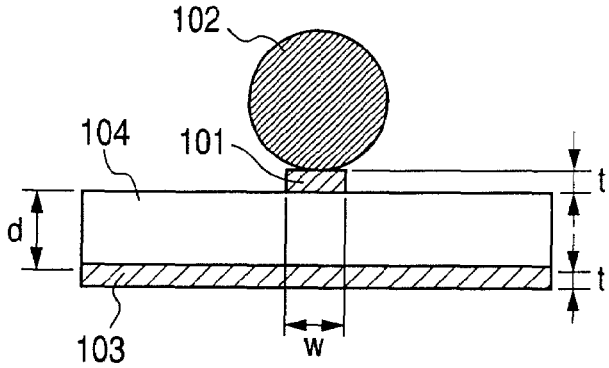

FIGS. 2A and 2B illustrate sectional views of the antenna device of FIG. 1. FIG. 2A is a sectional view cut in a YZ plane along the longitudinal direction of the first conductor section 101. FIG. 2B is a sectional view cut in a XZ plane in the central part of the antenna section 102. This embodiment will be described below with reference to FIG. 1 and both of FIGS. 2A and 2B.

The first conductor section 101 is a slim line with electroconductivity. Line length, line width and line height are defined as "L", "w" and "t", respectively. The first conductor section 101 is preferably made of a metal conductor. The second conductor section 103 is arranged so as to oppose the first conductor section 101 through the dielectric section 104, and is a flat conductor. The height of each conductor section is defined as t. Here, the heights of the first conductor section 101 and the second conductor section 103 are conveniently the same as each other, but may be different from each other. The second conductor section 103 defines a reference potential for each part of the antenna device. The second conductor section 103 can also be made of a metal conductor, but may be made by doping a carrier into a semiconductor substrate.

The dielectric section 104 is a dielectric thin film which is stacked on the surface of the second conductor section 103 to form an interface between them. The thickness of the dielectric thin film is represented by d. The thickness d of the stacked dielectric section 104 is sufficiently thin with respect to the wavelength of an electromagnetic wave to be used to such an extent as not to cause any confinement effect of the electromagnetic wave in the dielectric section. The dielectric section can be formed from such a material as to cause little loss in the wavelength range of the electromagnetic wave to be used. Examples of such material includes BCB (benzocyclobutene) though the material is not limited to BCB. The dielectric section can also be made of a resin material such as a polyimide-based resin and a polyolefin-based resin. The dielectric section can also be made of a semiconductor material such as high resistance silicon, or a porous fibrous material which is used in a membrane filter.

As illustrated in FIG. 1, a first conductor section 101, a second conductor section 103 and a dielectric section 104 constitute a waveguide which is referred to as a micro-strip line. Particularly in the present embodiment, the first conductor section 101 has a finite length L. Thereby, the waveguide forms a resonance circuit in which an electromagnetic wave being propagated in the waveguide is reflected at both the ends of the first conductor section 101. Specifically, the resonance circuit for a wavelength $\lambda$ is formed by controlling the length L of the first conductor section 101 to one-half (½) of $\lambda$ where the wavelength $\lambda$ is defined as an effective wavelength of the electromagnetic wave being propagated through the waveguide. In this specification, the resonance circuit including the first conductor section 101, the second conductor section 103 and the dielectric section 104 is referred to as a resonator section.

Here, as regards effective wavelength $\lambda$ when an electromagnetic wave to be used occupies a certain frequency band, wavelength $\lambda$ refers to the longest wavelength in the effective wavelength range capable of being propagated in an antenna device. It is because when the wavelength $\lambda$ is defined by the longest wavelength, shorter wavelengths than the longest wavelength can substantially achieve the intended purpose from the viewpoint of cut-off frequency of the antenna device.

Figure 9:
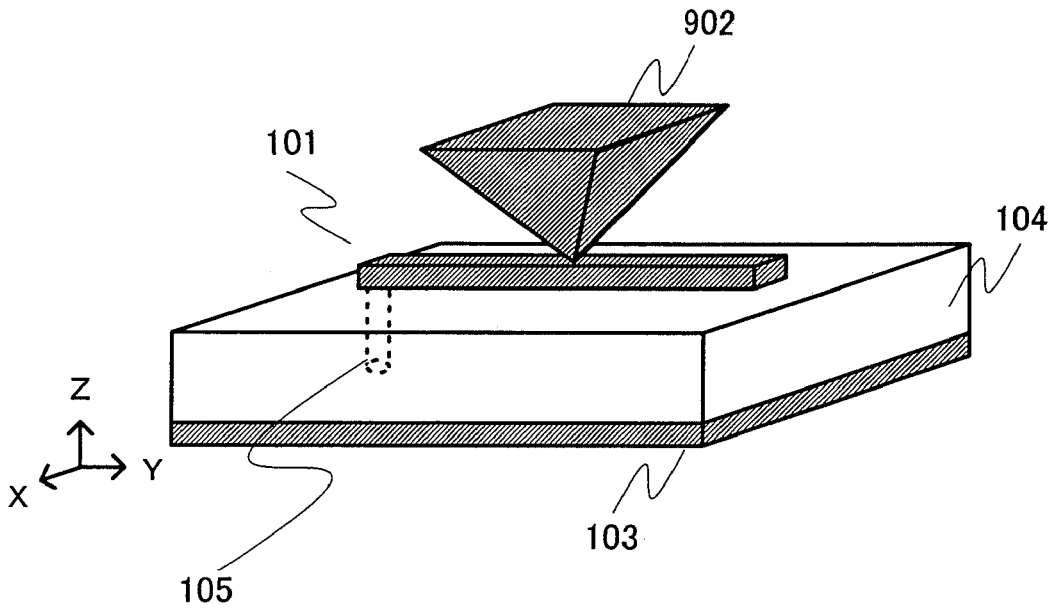
FIG. 9 is a perspective view showing another exemplary configuration of the antenna device according to the present invention.

The antenna section 102 is a solid or three-dimensional object having a surface adapted for propagating an electromagnetic wave. The antenna section 102 typically has a spherical structure at least the surface of which is made of a conductor. However, the configuration of the antenna section is not limited to a complete sphere but it may be a modified sphere having a partially nonspherical surface or an ellipsoid. Otherwise, the antenna section may have a conical or pyramidal structure as shown in FIG. 9, or a cylindrical structure having a conical end. The antenna section can be made of, for instance, a silicon sphere of which surface is coated with a metal. However, the material of the antenna section is not limited thereto.

FIG. 9 shows another exemplary configuration of the antenna device having a pyramidal antenna section 902. As shown in FIG. 9, the vertex of the pyramidal antenna section 902 is oriented toward the first conductor section 101. The pyramidal antenna section 902 of FIG. 9 can be fabricated typically by etching the silicon substrate into a pyramidal shape and forming a conductor on its end surface. The pyramidal antenna section thus formed is then laminated with the dielectric section 104. The pyramidal structure may also be made by using the MEMS (Micro-Electro-Mechanical Systems) technique.

A spherical ball entirely made of a metal, for example, can also be used. What is important is that the structure is capable of propagating an electromagnetic wave through the surface of the antenna section. While the antenna section will now be described as having a spherical shape below, the configuration of the antenna section is not limited to such a spherical shape. Again it should be noted that the antenna section may have an ellipsoidal shape, a conical or pyramidal shape, or any other shapes, as described above.

The antenna section 102 functions as an antenna together with the second conductor section 103 as a grounding conductor. The antenna section 102 and the second conductor section 103 are generically referred to as an antenna structure hereinafter. The antenna structure has a similar structure to that of a conical antenna. Accordingly, the antenna structure shows characteristics of a broad frequency band, which are similar to that of a conical antenna.

The antenna section 102 is arranged at an appropriate position on the first conductor section 101 or in the vicinity of the first conductor section. An electromagnetic wave which is propagated in a resonator section is radiated to the outside by the antenna structure. The antenna section 102 can be arranged approximately at a node of the electromagnetic field (the position at which electric field is approximately zero), so as to reduce the influence of the antenna section 102 on the electromagnetic wave propagated in the resonator section. However, in some applications, the position of the antenna section 102 is not limited to the above position. For instance, when controlling the phase state (inside the antenna device or of emitted electromagnetic wave) according to the positional relationship between the resonator section and the antenna structure, the position of the antenna section 102 may be intentionally deviated from the node of the electromagnetic field.

Generally, in order for an antenna section to function as an antenna, an electromagnetic wave with an objective wavelength needs to resonate in the antenna structure. For that, the antenna section 102 constituting the antenna structure needs to have a dimension (such as diameter) around the above described wavelength λ.

The semiconductor section 105 is arranged in the dielectric section 104 as sandwiched between the first conductor section 101 and the second conductor section 103. Both the ends of the semiconductor section 105 are in contact with the first conductor section 101 and the second conductor section 103 respectively. The semiconductor section 105 has a function for controlling a carrier, such as for generating a carrier or having a gain. For instance, the semiconductor section 105 constitutes a carrier generating mechanism comprising a photoconductive film which shows conductivity when irradiated with an external light. The semiconductor section 105 can also constitute a mechanism for providing a gain to a certain wavelength comprising a resonant tunneling diode (RTD), a quantum cascade laser, a Gunn diode, or the like.

In addition, the antenna device illustrated in FIG. 1 may have a bias circuit (not shown), as needed. The bias circuit is structured so as to apply a predetermined bias, for instance, between the first conductor section 101 and the second conductor section 103 (i.e. to both the ends of the semiconductor section 105).

The function as an antenna of the antenna device of the present invention will now be described below together with analysis results.

Figure 3:
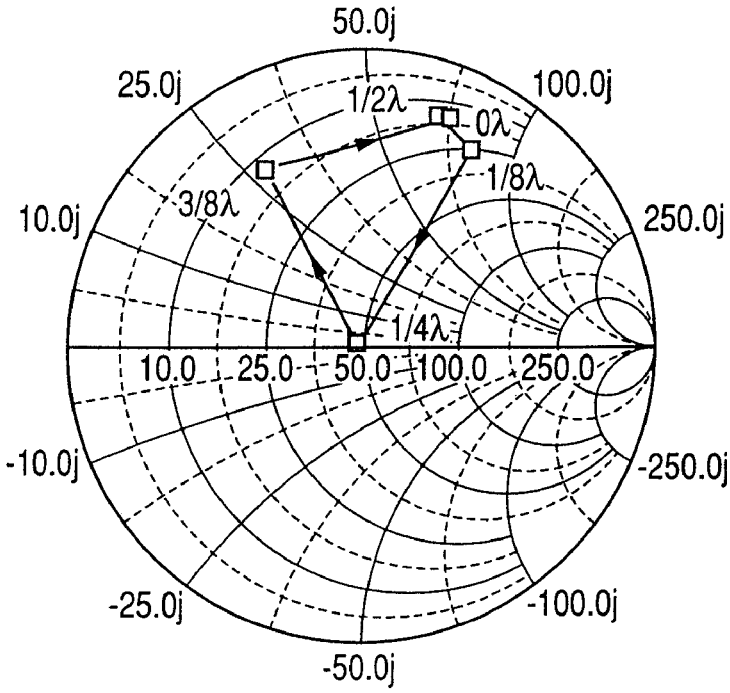
FIG. 3 is a Smith chart showing a change of the phase state of the antenna device of FIG. 1 due to a change of the arranged position of its antenna section.

As shown in FIG. 2A, the arrangement position of the antenna section 102 is defined by the distance D from an end of the first conductor section 101. In addition, the height of the antenna section 102 from the interface with the first conductor section 101 is represented by H. In the analysis below, the semiconductor section 105 as an electromagnetic wave source is located at a position where D=0. FIG. 3 is a graph plotting the value of impedance for the same frequency (1.2 THz) of the antenna device, which changes with the change of distance D representing the arrangement position of the antenna section 102. Other conditions are λ=300 μm, L=½ of λ, H=⅓ of λ, w=15 μm, t=0.5 μm and d=3 μm, while the dielectric section 104 was supposed to be air, for the sake of simplicity. In FIG. 3, the position at which D is ¼ of λ(where antenna section 102 is arranged at the center of the first conductor section 101) corresponds to a node of electromagnetic field, and it can be seen that the phase state changes clockwise as the distance D changes. It means that when the antenna device is used, for instance, as an antenna oscillating circuit, the phase state in oscillation can be controlled by the position of the antenna section.

Figure 10:
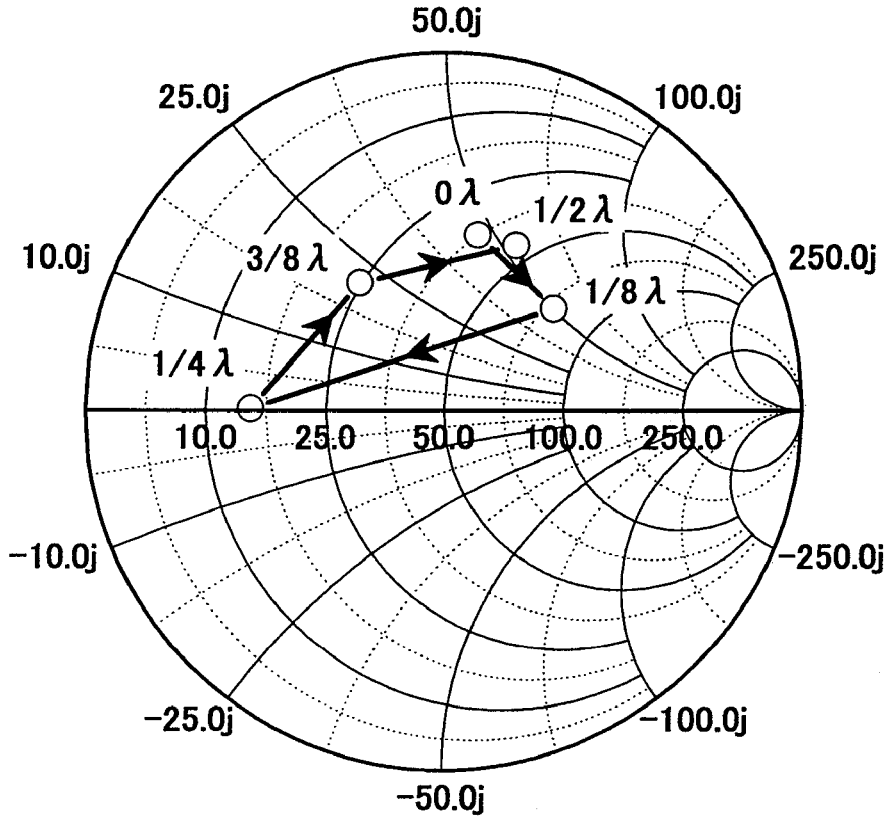
FIG. 10 is a Smith chart showing a change of the phase state of the antenna device of FIG. 9 due to a change of the arrangement position of its antenna section.

On the other hand, the antenna section 102 is replaced by the antenna section 902 shown in FIG. 9, the value of impedance for the same frequency (1.2 THz) of the antenna device is plotted in FIG. 10. As seen from FIG. 10, the value of impedance changes with the change of distance D representing the arrangement position of the antenna section 902. Other conditions are λ=300 μm, L=½ of λ, H=½ of λ, w=15 μm, t=0.5 μm and d=3 μm, while the dielectric section 104 was supposed to be air, for the sake of simplicity. Please note that the antenna height H is defined as the distance from the surface of the first conductor section 101 to the bottom surface (on the upper side in FIG. 9) of the pyramidal antenna section 902. Please also note that the bottom surface of the pyramidal antenna section 902 has a square shape with a side length of 200 μm while the vertex has an angle of 90 degree. As shown in FIG. 10, the phase state changes clockwise as the distance D changes, in the same manner as the case shown in FIG. 3. However, the adjustment amount of the impedance is changed as seen from FIG. 9. Thus, by selecting the configuration of the antenna section appropriately in accordance with the characteristics of the semiconductor section 105, the phase condition of the antenna oscillation circuit can be precisely controlled.

Figure 4:
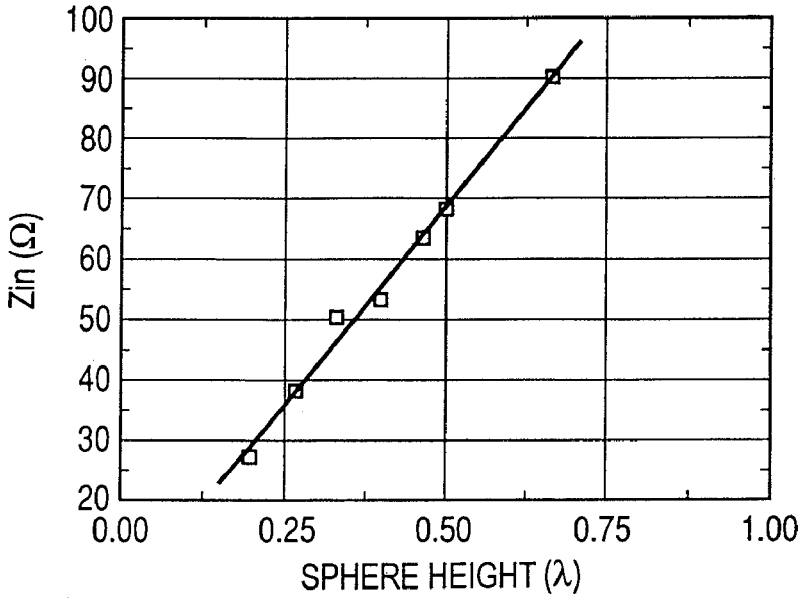
FIG. 4 is a graph showing a change of the input impedance of the antenna device of FIG. 1 due to a change of the height of its antenna section.
Figure 6:
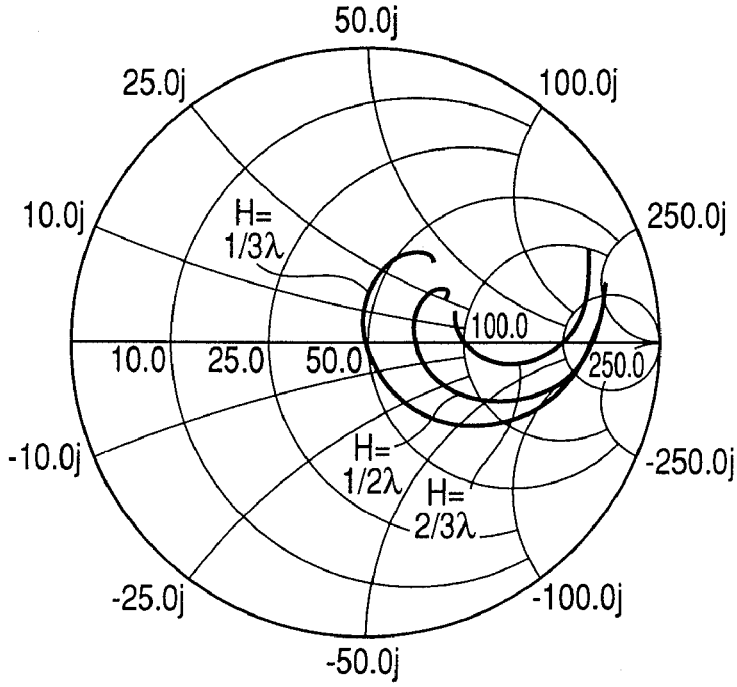
FIG. 6 is a Smith chart showing a change of the frequency characteristics of the antenna device of FIG. 1 due to a change of the height of its antenna section.

FIG. 6 is a graph plotting the frequency characteristics as the height H of the antenna section changes. The arrangement position D of the antenna section 102 is adjusted to ¼ of λ, and analytic frequencies between 1.0 THz and 1.4 THz are used. From FIG. 6, it can be seen that the input impedance of the antenna structure increases as the height H of the antenna section 102 increases. In the figure, the antenna resonance frequency (the point at which the imaginary number is zero) is almost constantly 1.2 THz. FIG. 4 is a graph plotting the value of input impedance of the antenna device with respect to the height H of the antenna section 102. From FIG. 4, it can be seen that the input impedance increases almost linearly as the height H of the antenna section 102 increases. It means that when the antenna device is used, for instance, as an antenna oscillating circuit, the load resistance can be increased by changing the height H of the antenna section 102 without changing the operating frequency.

Figure 5:
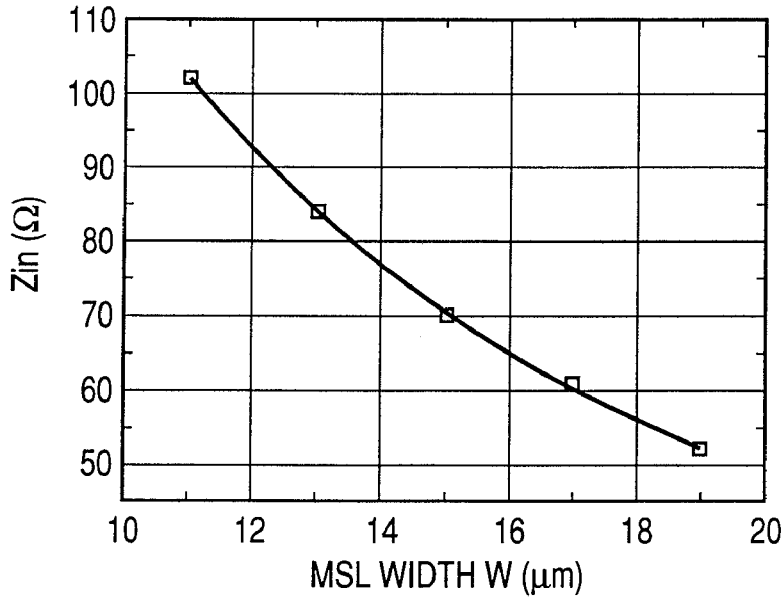
FIG. 5 is a graph showing a change of the input impedance of the antenna device of FIG. 1 due to a change of the line width of its first conductor section.

FIG. 5 is a graph plotting the value of input impedance of the antenna device as the line width w of the first conductor section 101 changes. The height of the antenna section 102 is adjusted to ½ of λ. Analytic frequencies between 1.0 THz and 1.4 THz are used. From FIG. 5, it can be seen that the input impedance increases approximately exponentially as the line width w of the first conductor section 101 decreases. It means that when the antenna device is used, for instance, as an antenna oscillating circuit, the load resistance can be increased by changing the line width w of the first conductor section 101 without changing the operating frequency.

When a photoconductive film is used in the semiconductor section 105, the antenna device of this embodiment radiates an electromagnetic wave outward due to generation of a carrier by irradiation with an external light. In addition, when a mechanism providing a gain to an electromagnetic wave is used as a semiconductor section 105, the antenna device of this embodiment functions as a load resistance for satisfying the conditions for starting oscillation and radiates an electromagnetic wave outward. The load resistance can be flexibly set by the above described method.

The antenna device according to the present embodiment has a structure in which an antenna section is supported by an external part (on the first conductor section of the resonator section), and accordingly can reduce the loss caused by the dielectric section 104 as compared to a planar antenna structure. In addition, the dielectric section 104 can be sufficiently thin (for instance, several micrometers, and 3 μm in the above described numeric example) as compared to the wavelength of an electromagnetic wave to be used (λ=300 μm in the above described numeric example). Accordingly, the structure will not readily cause an unnecessary propagation to occur, and accordingly can eliminate the confinement effect by the dielectric section 104. Thus, the antenna device of the present invention improves takeout efficiency (uptake efficiency in case of detection) for an electromagnetic wave.

When the antenna device of this embodiment is used as an oscillation device in particular, the antenna device can maintain a sufficient load resistance as described above in the terahertz wave region, and can therefore satisfy the oscillation conditions relatively easily. Thus, the oscillation device of this embodiment can be oscillated stably.

Next, more specific examples will be described with reference to the drawings. However, the antenna device of the present invention is not limited to those examples. The antenna device of the present invention can employ various shapes, materials and arrangements of each component within the scope described above in the SUMMARY OF THE INVENTION section.

EXAMPLE 1

In Example 1 described below, the antenna device of the present invention is used as an oscillator. FIG. 1 illustrates a schematic construction of the antenna device of this example.

In this example, the first conductor section 101 has a double layer structure of 0.5 μm of gold (Au) on 0.03 μm of titanium (Ti), which can be represented as Au (0.5 μm)/Ti (0.03 μm). Please note here that the values in parentheses indicate the thickness of each layer. The line length L is 150 μm, while the line width w is 15 μm. The second conductor section 103 is formed on a dielectric substrate (not shown) made of semi-insulating indium phosphide (InP). The second conductor section 103 is also made of a double layer structure of Au (0.5 μm)/Ti (0.03 μm). The dielectric section 104 is formed by applying a BCB film onto the second conductor section 103 to a thickness of 3 μm. The first conductor section 101 is printed on the dielectric section 104 to thereby form a resonator section.

In this example, the semiconductor section 105 constitutes an RTD. The semiconductor section 105 has an active layer of triple barrier quantum well structure containing a heterojunction of indium gallium arsenide (InGaAs)/indium aluminum arsenide (InAlAs). The active layer is formed by epitaxial growth on the dielectric substrate (not shown) by using molecular beam epitaxy (MBE). Subsequently, a layer of $n^+$-InGaAs doped with a high concentration of silicon (Si) is formed as a contact layer on the upper and lower sides of the above described active layer. Due to the contact layer, the semiconductor section 105 realizes continuity between the first conductor section 101 and the second conductor section 103.

The above described active layer of this example has a multilayer structure of InGaAs (5.0 nm)/InAlAs (2.66 nm)/InGaAs (5.61 nm)/InAlAs (2.66 nm)/InGaAs (7.67 nm)/InAlAs (2.66 nm)/InGaAs (5.0 nm) from the first conductor section 101 to the second conductor section 103.

Further, in this example, a bias circuit (not shown) is added between the first conductor section 101 and the second conductor section 103 so as to apply a bias voltage to the semiconductor section 105. The bias circuit is preferably connected to a position corresponding to a node of electromagnetic field (a position at which electric field is zero), in order to minimize the influence on an electromagnetic wave to be propagated in the antenna device.

The antenna section 102 employs a silicon ball coated with Au. The height H of the antenna section 102, specifically the diameter of the silicon ball, is 150 um. The antenna section 102 is connected with the first conductor section 101 at an arbitrary position through Au—Au crimping. However, the connection method is not limited to crimping. Any process technology such as an existing solder bonding technique can also be used.

The silicon ball used for the antenna section 102 has generally an (available) diameter in a range of tens of micrometers to hundreds of micrometers. The wavelength zone corresponding to the shape is equal to or less than one wavelength of the terahertz wave. For this reason, the antenna device of this example can be used in the terahertz wave region. On the other hand, the above described RTD can be estimated to have a real part of impedance of about 30 Ω or more in the terahertz wave region. Accordingly, the antenna device needs to have a load resistance of at least the value in order to satisfy a condition for starting the oscillation. In FIG. 4, the height H of the antenna section 102 for satisfying the condition is one-quarter of λ or more. Based upon the foregoing, when the antenna device is used in the terahertz wave region, the height of the antenna section 102 can be in the range of ¼ of λ to λ. In addition, the height from the interface between the first conductor section 101 and the dielectric section 104 to the top part of the antenna section 102 is preferably λ or less.

As is clear from FIG. 3 and FIG. 6 as well, the above descried antenna device changes the phase state depending on the arranged position and the height of the antenna section 102. Accordingly, the above described antenna device will obtain an oscillation state by adjusting the phase state by changing the arranged position and the height of the antenna section 102 on the first conductor section 101, so as to satisfy the conditions for starting oscillation. However, in some cases, a circuit for adjusting the phase such as a phase stub can be separately provided.

As described above, the antenna device of this example can maintain a sufficient load resistance in the terahertz wave region. Accordingly, the antenna device easily satisfies oscillation conditions and easily causes oscillation. In addition, for an antenna structure coping with a broad band, the antenna device acquires more points for satisfying the oscillation condition than a resonance type of an antenna such as a patch antenna, and consequently improves the yield of oscillation operation. Of course, the antenna device will show the effects mentioned above.

EXAMPLE 2

In Example 2 described below, the antenna device of the present invention is used as a photoconductive device. Please note that the same description as given above will be omitted to avoid repetition.

In the antenna device of this example, the semiconductor section 105 constitutes a photoconductive film. Specifically, the above described antenna device includes a thin film of gallium arsenide (GaAs) grown at a low temperature (LT) and transferred onto the second conductor section 103. Thus, a sacrificial layer of aluminum arsenide (AlAs) with a thickness of 100 nm and a LT-GaAs layer with a thickness of 2 μm are grown sequentially on a GaAs substrate, by MBE. Subsequently, an electrode is formed on the LT-GaAs layer surface, and the second conductor section 103 is bonded to the surface of the electrode with solder. Then, the GaAs substrate is etched with a mixture liquid of aqueous hydrogen peroxide and ammonia. The etching operation is stopped at the bottom of the above described sacrificial layer. The sacrificial layer is then removed with concentrated hydrochloric acid to form a photoconductive film. In the above description, the GaAs-based film is referred to as a photoconductive film, but the photoconductive film is not limited to a GaAs-based film. Other usable semiconductors include InP and indium arsenide (InAs). An organic semiconductor having photoconductivity may also be used.

In the antenna device of this example, the semiconductor section 105 is irradiated with an external light of e.g. an ultrashort pulsed-laser of titanium sapphire, while the bias voltage applied to the semiconductor section 105 from the above described bias circuit, the semiconductor section 105 generates a carrier by the light irradiation from the outside and radiates an electromagnetic wave caused by the carrier as a terahertz wave to the outside. This structure can also be used as a detector for a terahertz wave, as described in the BACKGROUND OF THE INVENTION section.

A conventional photoconductive device radiates a terahertz wave in both the directions along a normal line with respect to the antenna structure. The antenna device of this example specifies the directivity of the terahertz wave into one direction by the second conductor section 103. Accordingly, the antenna device will show a higher takeout efficiency (or uptake efficiency in detection) for an electromagnetic wave than the conventional photoconductive device. The antenna device also inhibits a terahertz wave from being radiated toward an unnecessary direction because of specifying the radiation direction of the terahertz wave into one direction, and facilitates, for instance, the integration of the antenna device.

EXAMPLE 3

Example 3 will be now described with reference to FIG. 7. This example is a modification of the above described examples. Specifically, the antenna device of this example has a special feature for holding the antenna section 102. Please note again that the same description is omitted to avoid repetition.

In the antenna device of this example, a first conductor section 101 is mechanically connected with an antenna section 102. Specifically, the top part of the spherical antenna section 102 is inserted into an opening of a holding section 706, as illustrated in FIG. 7. The antenna section 102 is thus covered with the holding section 706. The holding section 706 is then mechanically fixed on a dielectric section 104.

The holding section 706 is preferably made of a transparent member (i.e. causing little loss) for a terahertz wave. For instance, a resin material such as a polyimide-based resin or a polyolefin-based resin, and a semiconductor material such as high-resistance silicon can be used.

Figure 7:
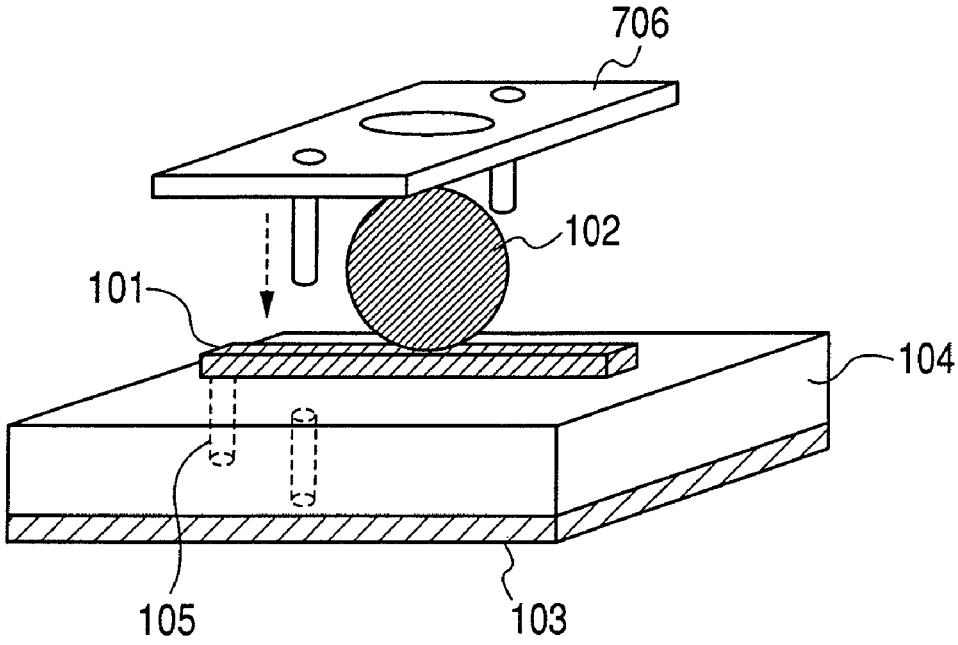
FIG. 7 is a perspective view showing the antenna device of Example 3.

For mechanically fixing the holding section, one or more holes are opened in the resonator section side, for instance, as illustrated in FIG. 7, and one or more pins provided in the holding section side into the holes. However, the fixing technique is not limited to the above. For instance, pins may be provided in the resonator section side and holes may be provided in the holding section side to fix the holding section 706. The important thing is that the holding section 706 and the resonator section have a form of sandwiching and mechanically fixing the antenna section 102. In addition, in FIG. 7, the first conductor section 101 composing the resonator section and the antenna section 102 are fixed in a form of contacting each other, but the fixed form is not limited to the contacting form. For instance, the antenna section 102 can be arranged above the first conductor section 101 at a certain gap by sandwiching the upper part and the lower part of the antenna section 102 with the holding section 706 to regard this as one unit; and fixing the unit at an arbitrary position in a height direction with respect to the resonator section.

In the antenna device of this example, the antenna section 102 is mechanically fixed on the first conductor section 101. Accordingly, the connected state of the antenna section 102 with the first conductor section 101 is not affected by the yield of a processing technology. As a result, the antenna device can stabilize a parasitic component in a connected part and consequently shows an effect of improving the yield of its performance as an antenna device. In addition, the antenna section 102 is fixed relative to the first conductor section 101 with a certain gap by an external retention mechanism. The gap can be used as a capacitance component. Thereby, when used, for instance, as an antenna oscillator, the antenna device increases parameters for matching a phase condition. As a result, the antenna device shows an effect of improving the yield of oscillation.

EXAMPLE 4

This example is a modification of the holding mechanism in Example 3. Again, the same description is omitted to avoid repetition.

Figure 8:
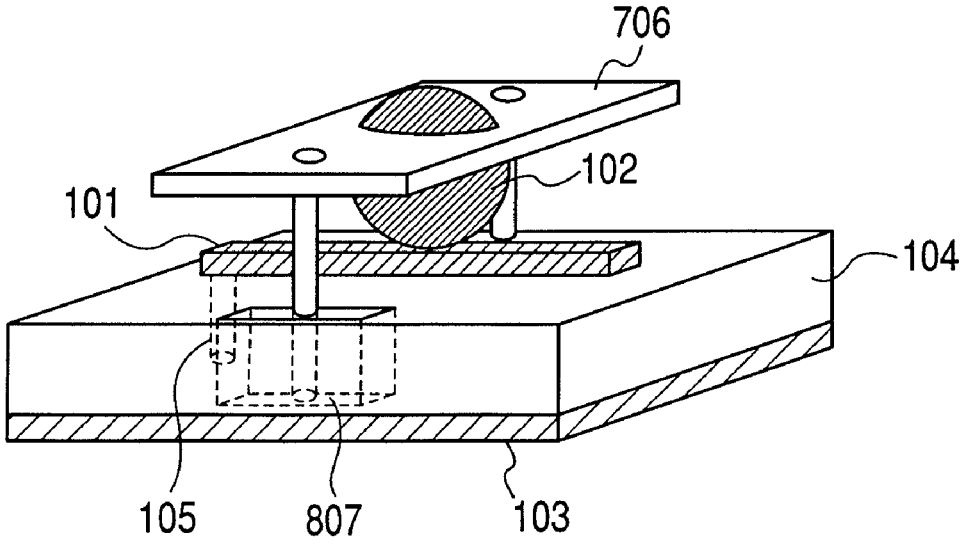
FIG. 8 is a perspective view showing the antenna device of Example 4.

The antenna device of this example has a movable section for changing the position of the holding section 706 for mechanically holding the antenna section 102. For instance, the antenna device has a groove-shaped movable section 807 on the resonator section side as is illustrated in FIG. 8. The movable section 807 can move the pin of the holding section 706 along the groove-shaped section in the longitudinal direction of the first conductor section 101. A structure of the movable section 807 is not limited to the above structure. For instance, an actuator such as a piezoactuator may be incorporated in the moving section, which changes its position according to an external control signal. Specifically, the piezoactuator may be installed on the respective sides of the groove-shaped movable section so as to sandwich the pin of the holding section 706, and the thickness of the piezoactuator on both the sides may be changed with a control signal to move the pin of the holding section 706 in the longitudinal direction of the first conductor section 101. In addition, the groove-shaped movable section 807 may be installed on the holding section 706 side as in Example 3.

Due to having such a structure, the antenna device can change the position of the antenna section 102, even after the antenna device has been produced. For instance, when the antenna device is used as an antenna oscillator, the position of the antenna section 102 can be adjusted again into a point satisfying an oscillation condition by monitoring the output of the antenna device. Alternatively, when the antenna device is used as a photoconductive device, the position of the antenna section 102 can be adjusted again to such a condition as to maximize the takeout efficiency. As a result, the antenna device shows an effect of increasing its yield and reducing its production cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-023596, filed Feb. 1, 2007, which is hereby incorporated by reference herein in its entirety.

What is claimed is:

1. An antenna device which works in a predetermined frequency band and has a resonator section, a semiconductor section and an antenna section, wherein the resonator section comprises a first conductor section, a dielectric section, and a second conductor section for specifying a reference potential against each section of the antenna device, which is arranged so as to oppose the first conductor section through the dielectric section;

the semiconductor section is arranged so as to be sandwiched between the first conductor section and the second conductor section; and the antenna section uses the second conductor section as a grounding conductor, is solid, makes at least its surface electroconductive, and is arranged on the first conductor section.

2. The antenna device according to claim 1, wherein the first conductor section has a length of one-half of λ, where λ is defined as a longest effective wavelength of an electromagnetic wave in the predetermined frequency band.

3. The antenna device according to claim 1, wherein the antenna section is arranged at a node of an electromagnetic field of an electromagnetic wave in the predetermined frequency band.

4. The antenna device according to claim 1, wherein the antenna section is arranged on variable positions which are on the first conductor section, and are deviated from a node of an electromagnetic field of an electromagnetic wave in the predetermined frequency band so as to thereby change a phase state of the electromagnetic wave that is propagated in the antenna device.

5. The antenna device according to claim 1, wherein the antenna section has a length of one-quarter of λ to λ, where λ is defined as a longest effective wavelength of an electromagnetic wave in the predetermined frequency band.

6. The antenna device according to claim 1, further comprising a holding section for holding the antenna section on the first conductor section.

7. The antenna device according to claim 6, wherein the holding section is movable in a longitudinal direction of the first conductor section so that the antenna section can be arranged in variable positions in a direction of an electromagnetic wave that is propagated in the antenna device.

8. The antenna device according to claim 1, wherein the semiconductor section has a gain for an electromagnetic wave in the predetermined frequency band.

9. The antenna device according to claim 1, wherein the semiconductor section is a photoconductive film which shows conductivity when being irradiated with a light.

10. The antenna device according to claim 1, wherein the predetermined frequency band is in a range of 30 GHz to 30 THz.

11. The antenna device according to claim 1, wherein the antenna section is spherical.

12. The antenna device according to claim 1, wherein the antenna section is conical or pyramidal.

* * * * *